United States Patent [19]

Palmaer

[11] 4,105,269

[45] Aug. 8, 1978

[54] KITCHEN CUPBOARD ASSEMBLIES

[76] Inventor: Tore Georg Palmaer, Smultronvägen 28, S-331 00 Värnamo, Sweden

[21] Appl. No.: 772,249

[22] Filed: Feb. 25, 1977

[30] Foreign Application Priority Data

Feb. 27, 1976 [SE] Sweden ..... 7602887

[51] Int. Cl.[2] ..... A47B 67/02

[52] U.S. Cl. ..... 312/248; 312/282; 312/314; 312/328

[58] Field of Search ..... 312/248, 292, 314, 317, 312/295, 138, 227, 270, 282, 328

[56] References Cited

U.S. PATENT DOCUMENTS

| | | | |
|---|---|---|---|
| 357,533 | 2/1887 | Miller | 312/292 |
| 1,526,672 | 2/1925 | Lockerbie | 312/22 |
| 1,883,504 | 10/1932 | Bolles | 312/292 |
| 2,194,333 | 3/1940 | Thompson | 312/22 |
| 2,551,305 | 5/1951 | Tompkins | 312/328 |
| 2,797,137 | 6/1957 | Forde | 312/328 |
| 2,820,686 | 1/1958 | Snyder | 312/282 |
| 2,873,161 | 2/1959 | Lambert et al. | 312/292 |
| 2,897,030 | 7/1959 | Ficarella | 312/314 |
| 3,346,308 | 10/1967 | Zimmerman | 312/328 |
| 3,846,005 | 11/1974 | Harper et al. | 312/248 |

*Primary Examiner*—Kenneth Downey
*Assistant Examiner*—Victor N. Sakran

[57] ABSTRACT

A kitchen cupboard assembly has a lower floor mounted cupboard unit with an upper working surface and an upper wall mounted cupboard unit which is mountable thereabove. A frame is hinged about a horizontal axis between a lower position in which it rests on the working surface and a raised position in which it forms a front door of at least one cupboard of the upper cupboard unit. The upper surface of the frame is used to support an item of kitchen machinery such as a domestic mixer, or the like, and this is folded away into the upper cupbard when not in use.

4 Claims, 3 Drawing Figures

KITCHEN CUPBOARD ASSEMBLIES

The present invention relates to kitchen cupboard assemblies.

Floor mounted kitchen cupboard assemblies are known which have an upper working surface. However, this working surface is of limited size and is used for a large number of different working operations in the kitchen. In recent times, a large number of special machines have been developed, as an object of reducing the amount of work necessary to be done by the housewife. These machines, such as domestic mixers, coffee percolators, bread slicers, electric whisks, have, however, to be easily accessible so that they may be used readily. They therefore often encroach upon the successful working surfaces available in the kitchen. Thus, such machines are often put away in the cupboard and since they are not readily accessible are used seldom.

It is now proposed, according to the present invention, to provide a kitchen cupboard assembly comprising a lower floor mounted cupboard unit having an upper working surface and at least one cupboard, an upper wall mounted cupboard unit, having at least one cupboard, a frame hinged about a horizontal axis between a lower position and an upper position and a support surface on said frame for supporting a piece of kitchen equipment.

With such an arrangement it is possible:

a. for the equipment so supported, when not in use, not to encroach on the working surface;

b. the equipment can be brought into use with the simple movement of one hand without any risk of accidents;

c. the macines can be cleaned without dirtying the surroundings; and d. the machines in their storage positions can occupy spaces which are of little interest for other purposes.

When the support frame is in its lower position, it can, for example, rest on the working surface of the lower cupboard. Alternatively, the frame can be provided with extendable support legs.

According to one advantageous embodiment, the support frame, when in its raised position, is located inside the door of the wall cupboard. Alternatively it may form the door of the wall cupboard.

Since the frame is advantageously mounted on a portion of the wall mounted cupboard unit, it can conveniently comprise a hinge, a first portion extending outwardly from said hinge, a second portion at the end remote from the hinge extending perpendicular thereto, the third portion extending from the second portion perpendicular thereto at the end remote from said first portion, and the support surface is provided at the end of the first portion remote from said second portion.

Such a frame can be mounted to co-operate with an existing wall mounted cupboard and floor mounted cupboard unit.

In order that the invention may more readily be understood, the following description is given, merely by way of example, reference being made to the accompanying drawings, in which.

Figure 1:
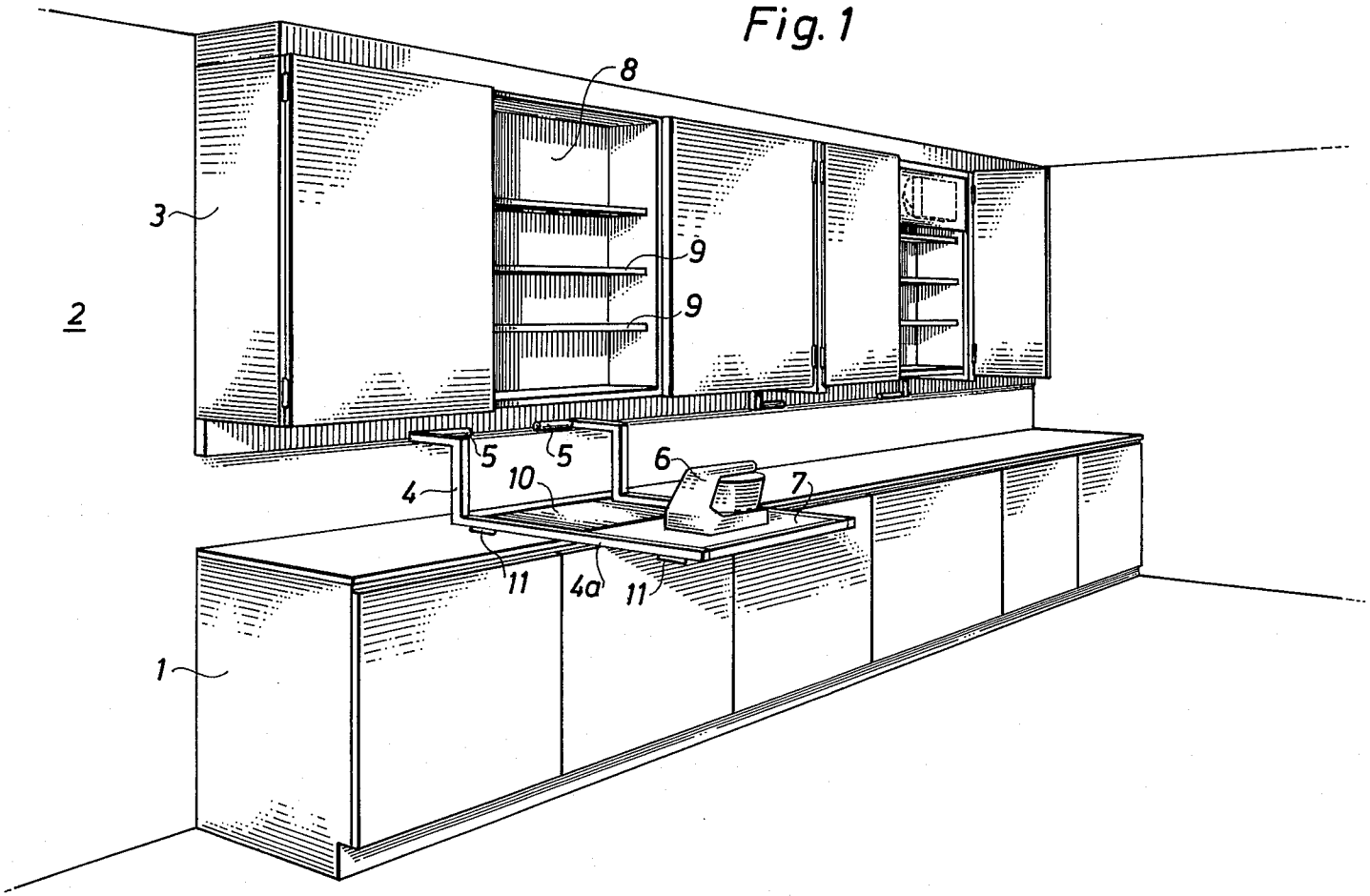
FIG. 1 is a perspective view of an assembly according to the present invention provided with two different forms of support frame.

Referring first to FIG. 1, a lower floor mounted cupboard unit 1 is shown mounted against a wall 2, the unit 1 having an upper working surface. Above the working surface of the unit 1 is a wall mounted cupboard unit 3.

As illustrated in FIG. 1, a frame 4 is pivotably mounted by hinges 5 to the lower surface of the cupboard unit 3. The frame has a first horizontally extending portion extending outwardly from the hinge, in the illustrated position. At the end remote from the hinge is a second portion extending perpendicular to the first. The length of the second portion is substantially equal to the depth of the cupboard of the upper cupboard unit 3. A third portion marked with the reference numeral **4*a* extends from the end of the second portion remote from the first portion, and has at its end remote therefrom, a support surface 7. On the support surface 7 can be mounted a piece of kitchen equipment, such as a domestic mixer 6**.

Figure 2:
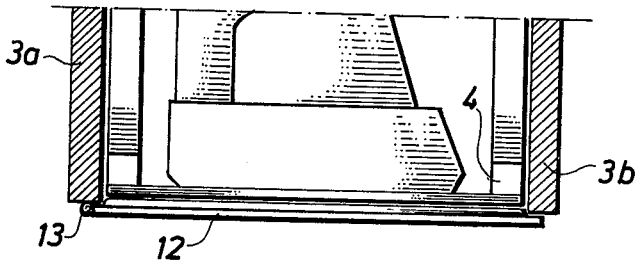
FIG. 2 is a horizontal section through one of the cupboards of the upper wall unit of FIG. 1.
Figure 3:
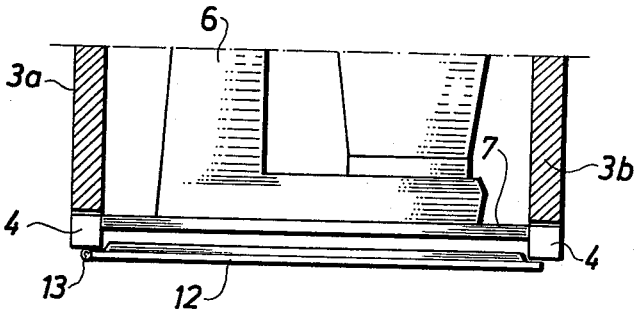
FIG. 3 is a section through another of the cupboards of FIG. 1.

As illustrated, the lower portion of the frame, that is the surface of the frame remote from the support surface 7, is provided with a plate or covering. This plate or covering may itself be hinged, as at 11, to the arm **4*a* of the frame so that when the frame is pivoted upwardly, and the mixer 6 is located in the space 8 at the top of the upper cupboard above the storage shelves 9, the door can be opened to give access to the materials stored. Alternatively, however, the whole frame can pivot placing the third frame portion 4*a* and the support surface within the perimeter of the cupboard as shown in FIG. 2, and the cupboard door, hinged at 13 to one sidewall 3*a* and abutting the other sidewall 3*b* of the cupboard 3, can close over the frame. In FIG. 3 the door 12 is shown pivoted to the frame 4 at 13** so that it is always mounted on that frame and pivots down with it.

In the lowered position of the frame, the piece of kitchen equipment 6 will be situated beyond the working surface of the unit 1. It will be understood that other machines than domestic mixers can be mounted on the support frame, for example, bread slicers, raw food centrifuges etc.

With the device according to the invention, a simple method is thus provided for storing kitchen machines requiring only a small space at the work surface concerned. The machines can be brought into a working position readily and advantageously, for this purpose, counterweights and/or springs are provided to assist in raising the units. Advantageously, these means are adjustable to suit the weight of a particular machine mounted on the working surface 7.

Most machines require table space when in use. According to the invention, the table space is provided by the support frame when it is lowered. It will be appreciated that the machine can be stored at the highest point of the cupboard, that is at 8 as shown in FIG. 1. This highest portion is seldom used by the housewife because it is not readily accessible so that the arrangement according to the invention enables one to use available storage space in the most advantageous manner.

I claim:

1. A kitchen cupboard assembly comprising, in combination:

a. a lower floor mounted cupboard unit, having an upper working surface and at least one cupboard therein;

b. an upper wall mounted cupboard unit having at least one cupboard therein, said upper wall mounted cupboard unit being spaced from the lower floor mounted cupboard unit having a vertical frontal face;

c. said latter at least one cupboard having a generally planar door, a support frame for said door extending about the periphery of said one cupboard, and hinge means for swinging said door relative to said frame about a vertical axis to open and close said at least one cupboard;

d. said frame having a bracket extension below said door and hinge means connecting the bracket extension to the lower edge of the face of said at least one cupboard, said support frame comprises a hinge means, a first portion extending away from said hinge means, a second portion perpendicular to said first portion and having a length substantially equal to the depth of said at least one cupboard, a third portion extending from said second portion parallel to said first portion, wherein said support surface is at the end of said third portion remote from said second portion for pivoting about a horizontal axis between a lower position and an upper position;

e. wherein the inside face of said door forms (i) a support surface extending horizontally in said lower position while resting against said upper working surface and (ii) a vertical cupboard door in said upper position;

f. said bracket extension being recessed within said at least one cupboard in said upper position and shaped so that in the lower position the associated frame and door rest in a horizontal plane upon the support surface of said lower floor mounted cupboard and extend cantilevered outwardly therefrom.

2. An assembly according to claim 1, wherein the support frame, in its upper position, is accommodated inside said cupboard door.

3. An assembly according to claim 1, wherein the hinge means for the support frame is provided on a lower portion of said at least one cupboard.

4. An assembly according to claim 3, wherein the hinge means is located immediately under the lower portion of said at least one cupboard.

* * * * *